US005588710A

United States Patent [19]

Wiecek

[11] Patent Number: 5,588,710

[45] Date of Patent: Dec. 31, 1996

[54] WALL AVOIDING RECLINING FURNITURE MECHANISM

[75] Inventor: Glenn N. Wiecek, Shelbyville, Ky.

[73] Assignee: L&P Property Management Company, Chicago, Ill.

[21] Appl. No.: 395,577

[22] Filed: Feb. 28, 1995

[51] Int. Cl.[6] ..... A47C 15/00

[52] U.S. Cl. ..... 297/463.1; 297/85

[58] Field of Search ..... 297/85, 68, 84, 297/83, 463.1

[56] References Cited

U.S. PATENT DOCUMENTS

| | | | |
|---|---|---|---|
| 3,758,151 | 9/1973 | Re . | |
| 4,108,491 | 8/1978 | Rogers, Jr. . | |
| 4,244,620 | 1/1981 | Harrison et al. . | |
| 4,249,772 | 2/1981 | Rogers, Jr. . | |
| 4,307,912 | 12/1981 | Watt et al. . | |
| 4,337,977 | 7/1982 | Rogers, Jr. et al. . | |
| 4,367,895 | 1/1983 | Pacitti et al. . | |
| 4,863,215 | 9/1989 | Crum . | |
| 4,989,914 | 2/1991 | Pine | 297/85 |
| 5,072,988 | 12/1991 | Plunk | 297/85 X |

*Primary Examiner*—Milton Nelson, Jr.
*Attorney, Agent, or Firm*—Wood, Herron and Evans, P.L.L.

[57] ABSTRACT

A reclining furniture mechanism which generally includes footrest linkage, backrest linkage, a seat link, stationary base structure as well as drive linkage and seat supporting and actuating linkage connected between the seat link and base structure. Footrest drive linkage is provided for smoothly and simultaneously extending and retracting the footrest linkage on opposite sides of the furniture item. The mechanism is particularly suited for use with T-cushion type frames associated with such furniture items as sofas, loveseats and modular sectionals.

8 Claims, 3 Drawing Sheets

WALL AVOIDING RECLINING FURNITURE MECHANISM

The present application is generally related to copending U.S. patent application Ser. No. 08/229,384 filed Apr. 18, 1994.

BACKGROUND OF THE INVENTION

The present invention generally relates to reclining or action furniture and, more particularly, to the linkage assembly of a three way reclining piece of furniture having a movable seat, backrest and footrest.

Reclining or so-called "action" furniture typically uses linkage mechanisms attached to the various frame components of the item of furniture for moving the backrest, seat and footrest between upright, intermediate or "TV", and fully reclined positions. Furniture having frame structure commonly referred to as a "T-cushion" frame includes three unitary frame components. These components are the backrest support frame, footrest support frame and the unitary seat and arm rest frame. When the T-cushion frame is constructed for use as a reclining furniture item, each of these components is movable with respect to the others as the item of furniture is supported on the floor by a stationary base structure. The base structure is usually formed as a rectangular metal rail assembly which is connected with the reclining mechanisms on both sides of the furniture item.

Examples of linkage mechanisms usable with T-cushion frames are disclosed in U.S. Pat. Nos. 4,108,491; 4,249,772; and 4,337,977. While mechanisms such as these operate adequately, there is generally a need for improvements including simplifying the mechanisms and reducing costs by reducing the number of links associated with the mechanism. It is also important, however, to maintain the ability of the mechanisms to produce smooth operation on both sides of the item of furniture. That is, it is desirable to have the mechanisms on both sides of the furniture item function simultaneously when the actuating handle on one side of the furniture item is moved back and forth to extend and retract the footrest.

Finally, it would be desirable to attain the above improvements while also providing a linkage mechanism which gives the furniture item "zero wall proximity". This refers to the ability to place the item of furniture with the top of the backrest against a wall while still retaining the ability to move the furniture item into "TV" and fully reclined positions without interference from the wall.

SUMMARY OF THE INVENTION

The present invention therefore has among its principal advantages a reduction in the number of links and therefore in the complexity of a mechanism particularly suited for use with T-cushion frames. Along with this follows a reduction in the costs associated with the mechanism as compared to past mechanisms. This reduction in cost and complexity is obtained while still achieving smooth, simultaneous operation of two mechanisms constructed in accordance with the invention and disposed on opposite sides of a furniture item, such as chairs, sofas and modular furniture. Also, furniture having mechanisms of this invention have "zero wall proximity" capability which can result in less wasted room space and more varied room seating arrangements.

A linkage mechanism constructed in accordance with the preferred embodiment of the invention includes a stationary base mounting member and a seat link connected together generally by drive linkage, seat supporting linkage and seat actuating linkage. Conventional scissor-type footrest linkage is also provided for moving a footrest between extended and retracted positions. The drive linkage is comprised of front and rear "over center" drive links each having lower ends pivotally connected to the base mounting member and upper ends pivotally connected to the seat actuating linkage. In accordance with the present invention, footrest actuating linkage is provided and includes a handle link having front and rear ends and being pivotal about an axis disposed between the front and rear ends. A footrest drive link is pivotally connected between the handle link rear end and the footrest linkage assembly and a ratio connecting link is pivotally connected between the handle link front end and the front drive link. Finally, a torsion bar is rigidly connected for rotation with the handle link about its axis of rotation. One end of the torsion bar may extend outwardly from an armrest of the furniture item and may be directly connected to a handle. The other end of the torsion bar is adapted to rigidly connect for rotation with a handle link of a second linkage mechanism.

In furtherance of providing a mechanism having relatively few links as compared to past mechanisms, the seat actuating linkage includes a generally "V"-shaped rear seat actuating link and a front seat actuating link. The rear seat actuating link includes a first end pivotally connected to the upper end of the rear drive link and a second end pivotally connected to a first end of the front seat actuating link. The rear seat actuating link further includes a pivot connection with a lower, angled section of the seat link at a point between the first and second ends of said rear seat actuating link. The front seat actuating link has its second end pivotally connected to the upper end of the front drive link. The backrest linkage includes a backrest link having a pivot connection with a rear, upper section of the seat link, and a backrest support link pivotally connected between the backrest link and the rear seat actuating link, An upper end of the backrest support link is pivotally connected to the backrest link rearward of the pivot connection between the backrest link and the seat link, while a lower end of the backrest support link is pivotally connected to the rear seat actuating link rearward of the pivot connection between the seat link and the rear seat actuating link.

Finally, a full recline guide link is connected between the front seat actuating link and the footrest linkage. The footrest linkage, and specifically a rear footrest link, includes a pin captured within an elongate slot of the guide link which has two closed ends for defining two positions for the pin. The pin moves from one closed end to the other closed end when the mechanism is moved between an intermediate position and a fully reclined position.

Further advantages of the present invention will become more readily apparent to those of ordinary skill in the art upon review of the following detailed description taken in conjunction with the accompanying drawings.

DETAILED DESCRIPTION OF THE PREFERRED EMBODIMENT

Figure 1:
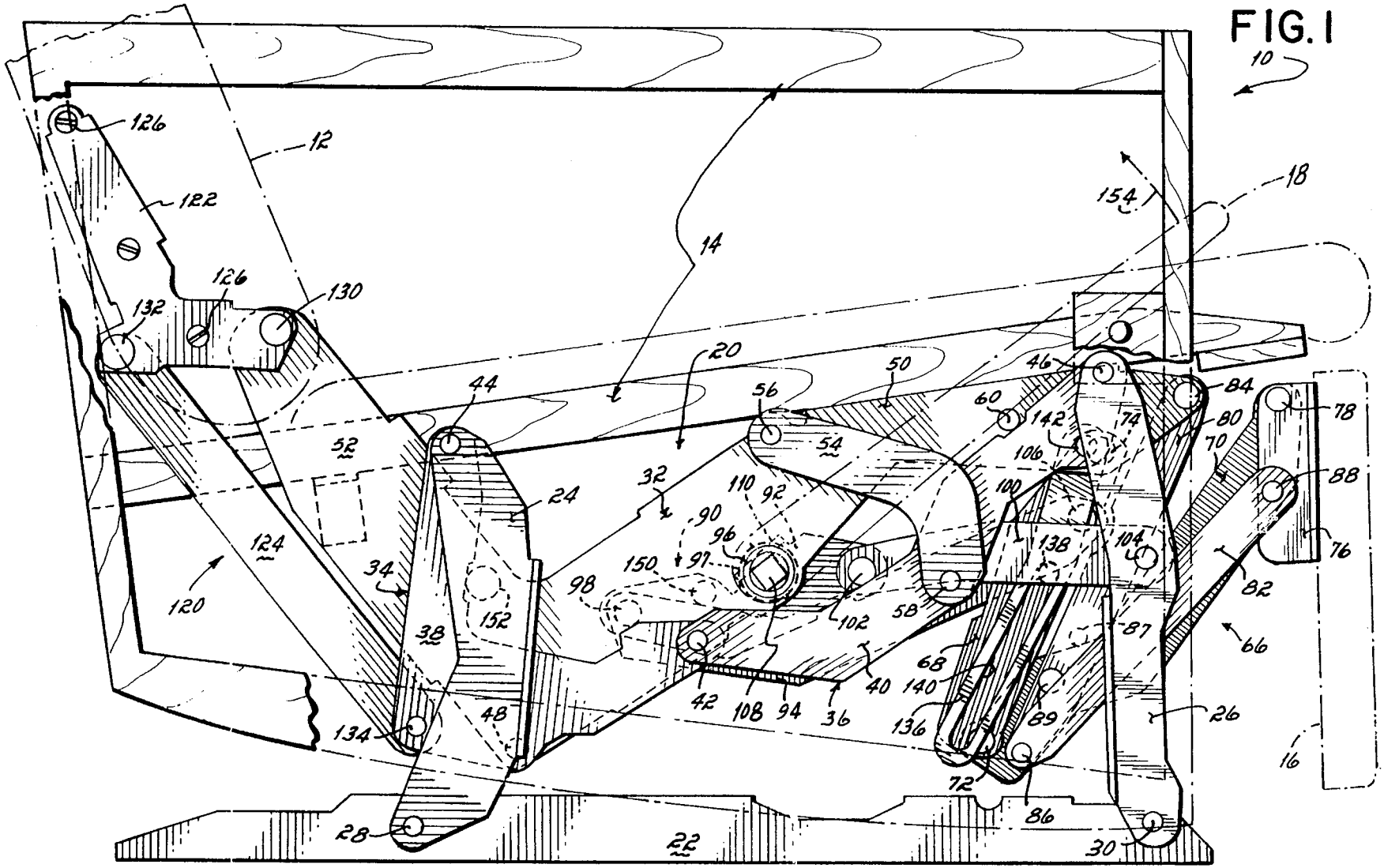
FIG. 1 is a side elevational view of a right side mechanism of the present invention as viewed from outside an item of reclining furniture having a T-cushion frame structure.
Figure 2:
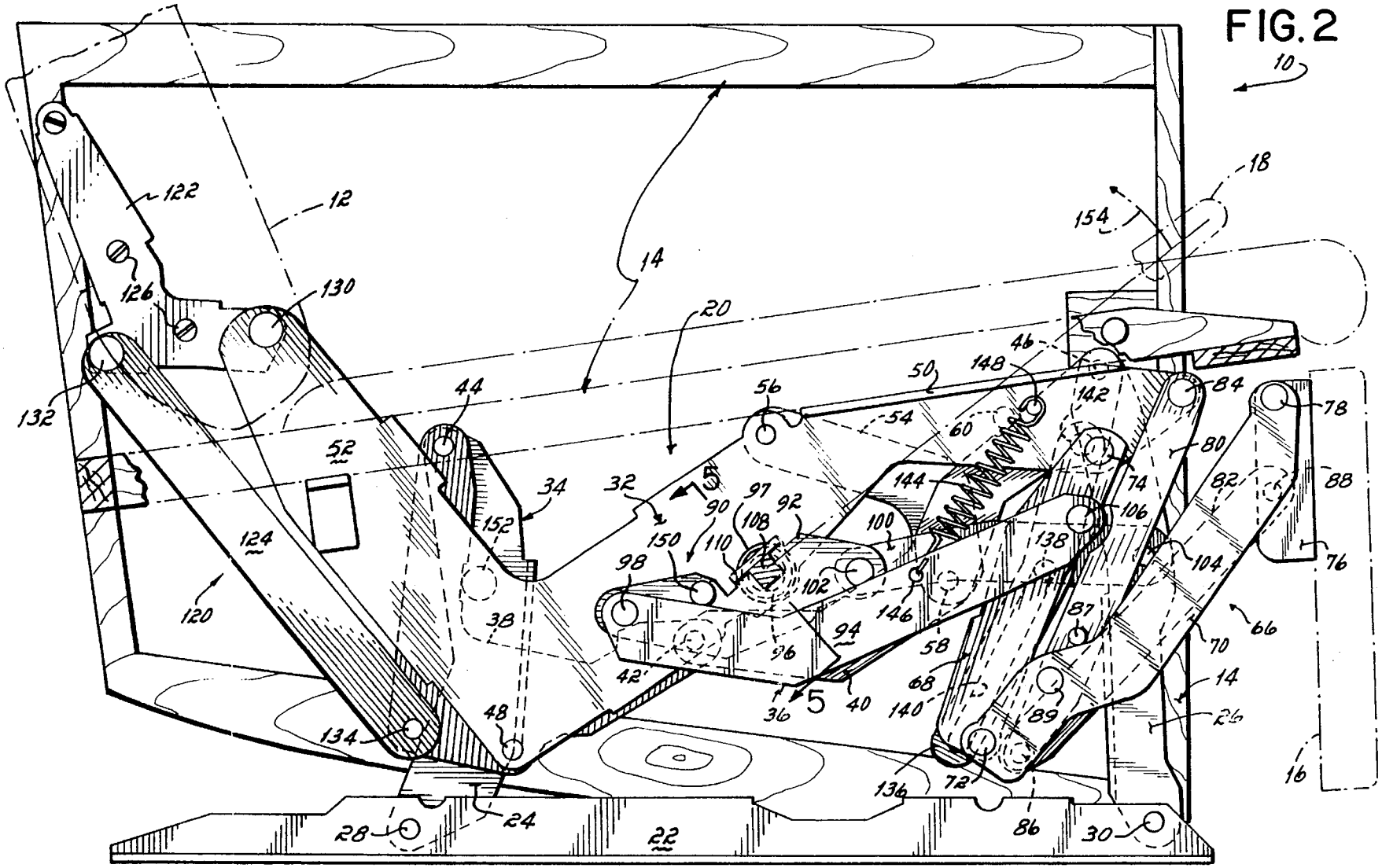
FIG. 2 is a side elevational view of a left side mechanism as viewed from inside an item of reclining furniture having a T-cushion frame structure.

As will be appreciated from the brief description of the drawings above, FIGS. 1 and 2 schematically illustrate an item of action furniture 10 which could be a reclining chair or sofa or any type of action furniture which includes a back frame structure 12, seat and armrest frame structure 14 and footrest frame structure 16 which are movable with respect to one another. This invention is most specifically directed to a reclining mechanism 20 usable with the so-called "T" cushion frame structure which is conventional and includes the three major components mentioned above. FIGS. 1 and 2 have been provided to show respective right and left hand side linkage mechanisms 20 of the present invention with FIG. 1 being a view of the right side mechanism 20 from outside the chair and FIG. 2 being a view of the left side mechanism 20 from inside the item of furniture 10.

Although left and right side mechanisms 20 are shown respectively in FIGS. 1 and 2, these mechanisms 20 are identical except that the right side mechanism includes an actuating handle 18 while the left side mechanism 20 does not. For purposes of simplicity, each of the linkages and other components of mechanism 20 have been given identical reference numerals as mechanisms 20 shown in FIGS. 1 and 2 are mirror images of one another.

Seat Supporting and Actuating Linkage

Referring first to FIG. 1, linkage mechanism 20 comprises a base mounting member 22 which may have suitable holes or slots (not shown) for receiving fasteners which mount base mounting member 22 to a floor supported side rail of a base frame structure (not shown). Extending upwardly from base mounting member 22 are a pair of drive links 24, 26. Rear drive link 24 is pivotally attached to the rear of base mounting member 22 by pivot connection 28 while front drive link 26 is pivotally attached to the front of base mounting member 22 by a pivot connection 30. A seat link 32 is supported from drive links 24, 26 by a seat supporting linkage assembly 34. Seat supporting linkage assembly 34 includes a seat actuating linkage assembly 36 comprising, in part, a generally "V"-shaped rear seat actuating link 38 and a front seat actuating link 40. First ends of seat actuating links 38, 40 are pivotally connected to one another by a pivot connection 42 while the second end of rear seat actuating link 38 is pivotally connected to rear drive link 24 by a pivot connection 44 and the second end of front seat actuating link 40 is pivotally connected to front drive link 26 by a pivot connection 46. To provide pivoting support for seat link 32, rear seat actuating link 38 is pivotally connected to a lower midportion of seat link 32 by a pivot connection 48. This lower midportion of seat link 32 is defined between an upper front seat supporting portion 50 and an upper rear seat supporting portion 52. In addition, a seat support link 54 is pivotally connected between seat link 32 and front seat actuating link 40 by respective pivot connections 56, 58. In the fully upright position shown in FIGS. 1 and 2 as well as in the "TV" position shown in FIG. 3, a stud 60 of seat link 32 rests on top of front seat actuating link 40. As a result of the connected seat supporting linkage described above, seat link 32 is supported or suspended from drive links 24, 26 by the rear seat actuating link 38 at the rear and by front seat actuating link 40 as well as seat support link 54 near the front.

Footrest Linkage

Figures 3, 4, 5:
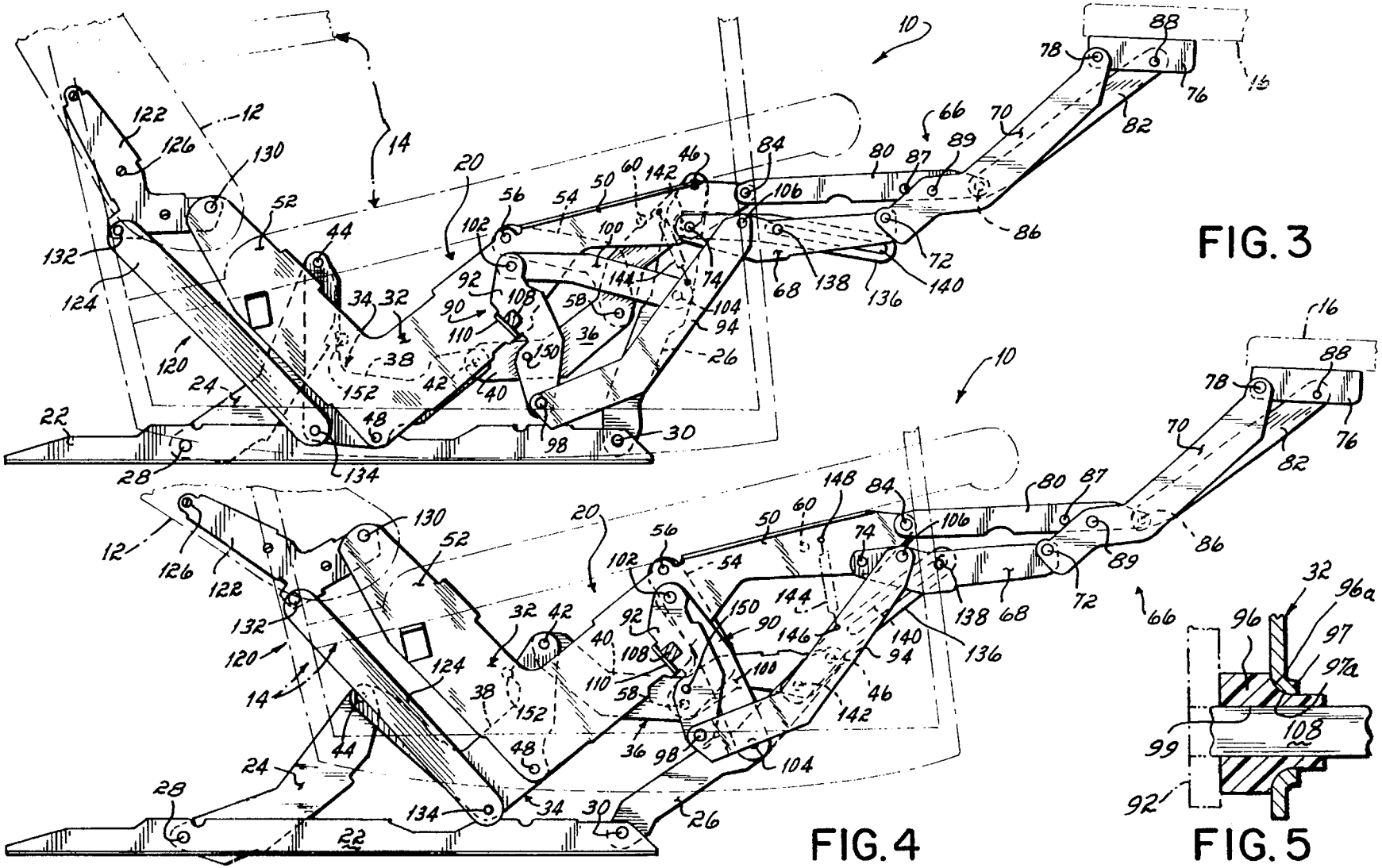
FIG. 3 is a side elevational view of the mechanism shown in FIG. 2 but showing the mechanism and furniture item in a semi-reclined or "TV" position.
FIG. 4 is a side elevational view of the mechanism shown in FIG. 2 but showing the mechanism and furniture item in a fully reclined position; and, FIG. 5 is a cross sectional view taken along line 5—5 of FIG. 2.

As best shown in FIGS. 2–4, footrest linkage assembly 66 is suspended from the front of seat link 32 and comprises scissor-type linkage. Footrest linkage 66 comprises a rear footrest link 68 and front footrest link 70 connected together at a pivot connection 72. An opposite end of rear footrest link 68 is connected to seat link 32 by a pivot connection 74 while a front end of front footrest link 70 is connected to a footrest support link 76 at pivot connection 78. Footrest linkage 66 further comprises first and second footrest connecting links 80, 82. The first footrest connecting link 80 is pivotally connected at its inner or upper end by a pivot connection 84 to seat link 32. At its lower end, first footrest connecting link 80 is connected to second footrest connecting link 82 by pivot connection 86. The upper end of the second footrest connecting link 82 is pivotally connected to footrest support link 76 by a pivot connection 88. Footrest links 68, 70 are also interconnected with footrest connecting links 80, 82 intermediate their ends by a pivot connection 89 made between link 70 and made between link 80. A stop stud 87 is affixed to rear footrest connecting link 80 and rests against an upper surface of front footrest link 70 when footrest linkage 66 has been fully extended as shown in FIGS. 3 and 4.

In order to effect extension and retraction of the footrest and movement of the item of furniture 10 from an upright position as shown in FIGS. 1 and 2 to an intermediate or "TV" position, linkage mechanism 20 includes footrest actuating linkage 90. Footrest actuating linkage 90 includes a handle link 92 and a footrest drive link 94. As best shown in FIGS. 1, 2 and 5, handle link 92 is mounted for rotation with respect to seat link 32 by a way of a bearing 96. Bearing 96 extends through seat link 32 and may be formed from a suitable low friction plastic material such as Nylon. As further shown in FIG. 5, bearing 96 is mounted in an extruded hole 97 in seat link 32 and held within that hole 97 by handle link 92. Hole 97 includes a curved inner surface **97*a* which mates with and rotates against a mating curved outer surface 96*a* of bearing 96. Mating surfaces 96*a*, 97*a* serve to prevent wear of bearing 96 during repeated turnings thereof as the footrest is repeatedly extended and retracted during use. Handle link 92 is further pivotally connected to footrest drive link 94 by a pivot connection 98 disposed at a rear end of handle link 92 as viewed in FIGS. 1 and 2**.

The front end of the handle link 92 is connected to a ratio connecting link 100 by a way of a pivot connection 102. The opposite end of ratio connecting link 100 is pivotally attached to the front drive link 26 at a pivot connection 104 which is disposed intermediate the opposite ends of front drive link 32. The forward end of footrest drive link 94 is connected to rear footrest link 68 by a pivot connection 106 which is disposed intermediate the opposite ends of rear footrest link 68. In accordance with the principles of the present invention, torsion bar 108 is rigidly fixed to handle link 92 and rotates about the same axis as handle link 92. Specifically, torsion bar 108 is rigidly fixed to a flange portion 110 of handle link 92 as by welding or screw fasteners (not shown). Torsion bar 108 extends through bearing 96 and rotates therewith. For example, the inner hole 99 of bearing 96 may be formed with a square cross section as is torsion bar 108. Torsion bar 108 is long enough to extend through one armrest of the furniture item 10 such that a lower end of handle 18 may be rigidly affixed thereto in any conventional manner such as by the use of a conventional set screw (not shown). Torsion bar 108 is connected to both the right hand and left hand mechanisms 20 of the item of action furniture 10 so that the footrest actuator link 94, ratio connecting link 100 and front drive link 26 on each side of the item of furniture 10 are simultaneously and very smoothly moved by the back and forth movement of handle 18 on only one side of the furniture item 10.

Backrest Linkage and Wall Avoidance Feature

Referring to FIGS. 1–4, linkage mechanism 20 further includes backrest linkage 120 for supporting the backrest frame 12 for pivotal movement relative to seat frame 14. Backrest linkage 120 comprises a backrest link 122 and a backrest support link 124. Backrest link 122 is rigidly secured to the backrest frame 12, for example, by screw fasteners 126. A lower end of backrest link 122 is pivotally connected to upper end 52 of seat link 32 by a pivot connection 130. An upper end of backrest support link 124 is pivotally connected to an angled midportion of backrest link 122 by a pivot connection 132. A lower end of backrest support link 124 is pivotally connected to rear seat actuating link 38 by a pivot connection 134.

Thus, as further explained below, it will be appreciated that as the backrest frame 12 is reclined or, in other words, as backrest link 122 is rotated counterclockwise about pivot 130, as viewed in FIGS. 3 and 4, backrest support link 124 will cause rear seat actuating link 38 to also rotate counterclockwise. This will cause rear drive link 24 to rotate clockwise about pivot 28 and move its upper end in a forward direction thereby also moving seat link 32 in a forward direction. During this "wall avoiding" movement, a slotted guide link 136 connected between front seat actuating link 40 and rear footrest link 68 moves from the position shown in FIG. 3 to the position shown in FIG. 4. Specifically, a guide pin 138 rigidly affixed to rear footrest link 68 slides within a slot 140 in guide link 136 from a rear end of slot 140 to a front end of slot 140. During this movement, the rear end of front seat actuating link 40 moves upward and the front end thereof moves downward as guide link 136 rotates counterclockwise about its pivot connection 142 to front seat actuating link 40 and as guide slot 140 moves with respect to guide pin 138 as discussed above,

Operation of the Linkage Mechanism

Referring first to FIG. 2, when the furniture item 10 is in a fully upright position, linkage mechanism 20 with backrest linkage 120 in a fully upright position, linkage mechanism 20 with backrest linkage 120 in a fully upright position and footrest linkage 66 fully retracted, is maintained in this position by a spring 144 connected between a hole 146 in footrest drive link 94 and a stud 148 connected to seat link 32. Spring 144 applies a biasing force to footrest drive link 94 and therefore to handle link 92. Biasing force provided by spring 144 therefore maintains footrest drive link 94 against a stop stud 150 extending outwardly from handle link 92. Pivot 102 is also maintained in an "over center" position. As further shown in FIG. 2, in the fully upright position, rear seat actuating link 38 bears against a stop stud 152 which is rigidly affixed to seat link 32. Also, stop stud 87 of footrest connecting link 80 bears against an upper surface of front footrest link 70.

When a person is seated in the furniture item 10 and linkage mechanism 20 is in a fully upright position with the footrest fully retracted, the weight of the person seated in the furniture item 10 tends to bias seat link 32 rearwardly because of the orientation of the pivot connections 30, 46 between front drive link 26 and base mounting member 22 and front drive link 26 and front seat actuating link 40, respectively. To initiate reclining movement of furniture item 10, seat link 32 must be moved forwardly to a point at which the pivot connection 46 of front drive link 26 moves forwardly of the pivot connection 30 of this same front drive link 26. When this occurs, the weight of the person seated in the furniture item 10 tends to continue to force the drive links 24, 26 to pivot in a clockwise direction, as viewed in FIG. 2, about their respective pivot connections 28, 30 to base mounting member 22.

To initiate forward movement of seat link 32 relative to base mounting member 22, a handle 18 is connected to torsion bar 108 and is pulled rearwardly in the direction of arrow 154 to rotate handle link 92 in a counterclockwise direction about an axis which is defined by the longitudinal axis of torsion bar 108. This movement of handle link 92 results in footrest linkage 66 being moved forwardly by footrest drive link 94. Once this reclining movement is initiated by rotation of handle link 92, and as soon as pivot 46 of front drive link 26 moves forwardly of the lower pivot connection 30 of front drive link 26, the opening or extending movement of footrest linkage 66 will continue as a consequence of the weight of the person in the furniture item 10 causing clockwise rotation of front drive link 26 and forward movement of seat link 32 through ratio connecting link 100. This opening movement of footrest linkage 66 will continue until stop stud 87 on footrest connecting link 80 hits the upper surface of front footrest link 70. This is the intermediate or "TV" position of linkage mechanism 20 as illustrated in FIG. 3 with backrest linkage 120 in an upright position and footrest linkage 66 in a fully extended position.

When it is desired to move from the "TV" position to the fully reclined position shown in FIG. 4, the occupant of furniture item 10 simply leans back against the backrest of furniture item 10. This has the effect of pivoting rear seat actuating link 38 counterclockwise, as viewed in FIGS. 3 and 4, about its pivot connection 48 with seat link 32. Simultaneously, full reclining motion moves the upper ends of drive links 24, 26 further forwardly along seat link 32. This rearward pivoting movement of the backrest and attached backrest link 122 may continue until stop stud 152 rigidly affixed to seat link 32 is contacted by rear seat actuating link 38 as shown in FIG. 4.

In order to move linkage mechanism 20 from the fully reclined position shown in FIG. 4 to the intermediate or "TV" position of FIG. 3, all that is required is for a person seated in furniture item 10 to lean forwardly and take his weight off of the backrest 12. This causes the backrest 12 to move to an upright position as a consequence of the weight of a person seated in furniture item 10 causing a force to be applied to the backrest link 122 by way of backrest support link 124. To move linkage mechanism 20 all the way back to the fully upright position shown in FIGS. 1 and 2, the person simply uses his legs to push downwardly on the footrest 16.

While a single preferred embodiment of the present invention has been shown and described, persons skilled in the art to which this invention pertains will readily appreciate many modifications and substitutions which may be made without departing from the spirit of the invention. Therefore, Applicant does not intend to be limited except by the scope of the appended claims.

What is claimed is:

1. A linkage mechanism for an item of reclining furniture having a unitary seat and armrest frame structure, a backrest frame structure and a footrest frame structure each being movable with respect to each other between fully upright and fully reclined positions, said mechanism comprising:

a stationary base mounting member;

front and rear drive links pivotally connected at spaced locations to said base mounting member;

a seat link having upper front and rear sections and a lower section therebetween;

a seat supporting linkage assembly connected generally between said front and rear drive links and between said base mounting member and said seat link, said seat supporting linkage assembly including a seat actuating linkage assembly pivotally connected at one end to an upper portion of said front drive link and at another end to an upper portion of said rear drive link;

a footrest linkage assembly connected to said front end of said seat link and movable between extended and retracted positions relative to said seat link; and, footrest actuating linkage including:

a) a handle link having front and rear ends and being pivotal about an axis disposed between said handle link front and rear ends;

b) a footrest drive link pivotally connected between said handle link rear end and said footrest linkage assembly;

c) a ratio connecting link pivotally connected between said handle link front end and said front drive link; and, d) a torsion bar rigidly connected for rotation with said handle link about said axis, said torsion bar extending transversely to said linkage mechanism and adapted to connect with a handle link of a second linkage mechanism.

2. The linkage mechanism of claim 1 further comprising a spring connected between said seat link and said footrest drive link.

3. The linkage mechanism of claim 1 further comprising a bearing secured to said seat link, said torsion bar being supported for rotation with respect to said seat link by said bearing.

4. The linkage mechanism of claim 3 wherein said bearing rotates with said torsion bar and with respect to said seat link, and said bearing and said seat link include curved bearing surfaces disposed for rotation against one another.

5. The linkage mechanism of claim 1 wherein said seat actuating linkage assembly includes a generally "V"-shaped rear seat actuating link and a front seat actuating link, said rear seat actuating link having a first end pivotally connected to an upper end of said rear drive link and a second end pivotally connected to a first end of said front seat actuating link, said rear seat actuating link further having a pivot connection with the lower section of said seat link at a point between the first and second ends of said rear seat actuating link, and said front seat actuating link having a second end pivotally connected to an upper end of said front drive link.

6. The mechanism of claim 5 further comprising a full recline guide link connected between said front seat actuating link and said footrest linkage assembly, said footrest linkage including a pin captured within a slot having two closed ends and contained within said full recline guide link, wherein said pin moves from one closed end to the other closed end when said mechanism is moved between an intermediate position and a fully reclined position.

7. The linkage mechanism of claim 5 further comprising backrest linkage including a backrest link having a pivot connection with said upper rear section of said seat link, and a backrest support link pivotally connected between said backrest link and said rear seat actuating link.

8. The linkage mechanism of claim 7 wherein an upper end of said backrest support link is pivotally connected to said backrest link rearward of the pivot connection-between said backrest link and said seat link, and a lower end of said backrest support link is pivotally connected to said rear seat actuating link rearward of the pivot connection between said seat link and said rear seat actuating link.

* * * * *